United States Patent [19]

Stockmeier et al.

[11] Patent Number: 4,570,412

[45] Date of Patent: Feb. 18, 1986

[54] DROPPED-PACKAGE CATCHER

[75] Inventors: Glenn R. Stockmeier, Troy; Fritz F. Treiber, Centerville, both of Ohio

[73] Assignee: Hobart Corporation, Troy, Ohio

[21] Appl. No.: 578,146

[22] Filed: Feb. 8, 1984

[51] Int. Cl.[4] ..... B65B 61/00

[52] U.S. Cl. ..... 53/167; 53/228; 198/389

[58] Field of Search ..... 53/53, 54, 167, 228, 53/229, 230, 231, 232, 441; 198/389

[56] References Cited

U.S. PATENT DOCUMENTS 3,377,776 4/1968 Arvidson ..... 53/53

*Primary Examiner*—Robert L. Spruill
*Assistant Examiner*—Richard M. Mudd
*Attorney, Agent, or Firm*—Biebel, French & Nauman

[57] ABSTRACT

Packages which may drop from an elevator or other package supporting/conveying apparatus in a package elevating wrapping machine are caught by a package catcher comprising a pan having upwardly extending edges which is coupled to the elevator and reciprocated therewith. The pan is supported in a generally horizontal attitude to receive dropped packages. A package guide is positioned adjacent to a package feed-in tray to direct packages which may drop to the pan. The edge of the pan which extends toward the package guide is preferably angularly oriented and lengthened to be substantially aligned with the package guide when the elevator is in its lowered position. The distal end of the lengthened pan edge is maintained in close proximity to the package guide throughout the reciprocating motion of the elevator and package catcher to facilitate passage of a dropped package to the pan.

4 Claims, 3 Drawing Figures

DROPPED-PACKAGE CATCHER

BACKGROUND OF THE INVENTION

The present invention relates generally to wrapping machines wherein packages are conveyed to an elevator to raise them into sheets of wrapping material which are folded about the packages and, more particularly, to a package catcher associated with the elevator of a wrapping machine for catching packages which are inadvertently dropped from the elevator or from a package conveyor which transports packages to the elevator.

Wrapping machines which include package elevators are well known in the art. In such machines, packages, typically comprising trayed commodities, are conveyed to an elevator which raises the packages into a sheet of wrapping material. The sheet of wrapping material is then folded about the package and secured to the bottom thereof to form a package for attractively displaying the commodities. An illustrative package elevating wrapping machine which utilizes film wrapping material is disclosed in U.S. patent application Ser. No. 371,681, filed by Fritz Treiber et al., on Apr. 26, 1982 and entitled "Wrapping Control System for Film Wrapping Machine," which application is now U.S. Pat. No. 4,501,106, is assigned to the assignee of the present application and is incorporated herein by reference.

In known package elevating wrapping machines, a chute or slide is positioned adjacent to the elevator and inclined away from the elevator to catch and direct dropped packages toward the operator end of the machine. An operator may then open the machine to retrieve a dropped package and replace the package to be wrapped into the wrapping machine.

In the interest of space saving, wrapping machines are preferably compact and include relatively dense construction of mechanical apparatus to perform the wrapping. See, for example, the above-referenced U.S. patent application Ser. No. 371,681 now U.S. Pat. No. 4,501,106. Accordingly, packages which are inadvertently dropped to the package catching slide, particularly in the case of larger sized packages, may interfere with or be engaged by operating mechanisms within the wrapping machine. For example, in the machine of the above-referenced patent application, a package pusher is continuously circulated in close proximity to the package catching slide. If a dropped package remains on the slide, the package pusher may engage and jam the package potentially damaging or jamming the machine and/or destroying the engaged package.

It is, thus, apparent that the need exists for improved apparatus for catching packages which are dropped from an elevator or other supporting or conveying apparatus of a package elevating wrapping machine to prevent potential destruction of the dropped packages as well as damage to or jamming of the wrapping machine itself.

SUMMARY OF THE INVENTION

In accordance with the present invention, the problems associated with the prior art dropped package slide are overcome by catcher means coupled to an elevator of a package elevating wrapping machine. The catcher means follows the reciprocating movement of the elevator to be ever present and available for catching a dropped package. While the catcher means can be coupled to the elevator in any convenient way, in the illustrative embodiment, the elevator is supported on a shaft reciprocated in a vertical direction by a pivotally mounted elevator control arm and stabilized by a pivotally mounted stabilizing arm to maintain the shaft in a generally vertical orientation throughout its reciprocating motion and the catcher means is connected to the stabilizing arm.

The catcher means preferably comprises a pan having upwardly extending edges with the pan being supported in a generally horizontal attitude. To ensure that packages which might inadvertently drop prior to passing to the elevator are properly caught, the catcher means further comprises a package guide positioned to direct packages from a horizontal package feed-in tray to the pan. The edge of the pan which extends toward the package guide is preferably angularly oriented and lengthened to be substantially aligned with the package guide when the elevator is in its lowered position. The distal end of the lengthened pan edge is maintained in close proximity to the package guide throughout the reciprocating motion of the elevator to facilitate passage of a dropped package to the pan.

It is, therefore, an object of the present invention to provide an improved package catcher to receive packages which are dropped from an elevator or package supporting or conveying apparatus preceding the elevator in a package elevating wrapping machine to prevent such dropped packages from falling into operating apparatus of the wrapping machine and thereby prevent potential destruction of the dropped package, damage to the machine and/or machine jams.

Other objects and advantages of the invention will be apparent from the following description, the accompanying drawings and the appended claims.

DETAILED DESCRIPTION OF THE INVENTION

Overall operation of a package elevating wrapping machine is fully described in the above-referenced U.S. patent application Ser. No. 371,681 now U.S. Pat. No. 4,501,106. Accordingly, only the operation of the limited portion of such a wrapping machine relating to package feed-in and conveyance to the elevator will be described herein to facilitate description of the dropped-package catcher in accordance with the present invention.

Figure 1:
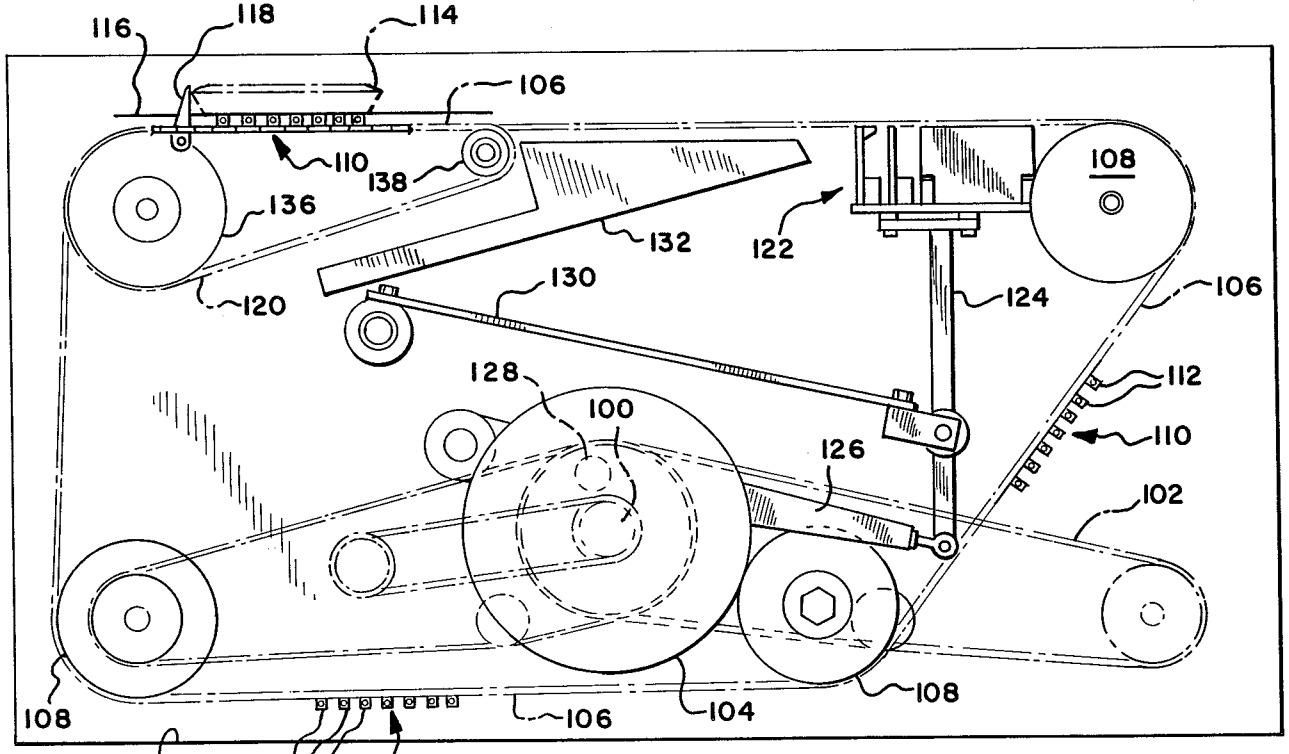
FIG-1 PRIOR ART
FIG. 1 is a diagrammatical vertical cross-section taken generally along the longitudinal center line of a package elevating wrapping machine illustrating the prior art chute or slide for catching dropped packages.

As shown in FIG. 1 which illustrates the prior art dropped package handling apparatus, a main drive shaft 100 is driven by an electric motor (not shown) and a gear reduction drive (not shown) through a chain 102. The main drive shaft 100 drives an elevator cam 104 and also drives chains 106 around sprockets 108. Supported on the chains 106 are three circulating platforms 110 which are comprised of cylindrical shafts or rods 112 mounted to the conveyor chains 106.

A package 114 to be wrapped typically comprises meat or other food products placed upon a shallow tray such that a transparent film can be wrapped about the package to protect the contents of the tray and yet form a package which attractively displays the contents. The package 114 is placed on a package feed-in tray 116. A package feed-in pusher 118 which is connected to and circulated on conveyor chains 120 advances the package 114 into the wrapping machine. As the package 114 is advanced beyond the end of the package feed-in tray 116, it is supported and carried forward by one of the three circulating platforms 110.

The package 114 is carried on one of the platforms 110 to an elevator 122 which in turn elevates the package 114 into a sheet of wrapping material as is fully disclosed in the above referenced U.S. patent application Ser. No. 371,681 now U.S. Pat. No. 4,501,106. The elevator 122 is supported on a shaft 124 which is reciprocated in a vertical direction by a pivotally mounted elevator control arm 126 by means of the elevator cam 104 which engages a cam follower 128 connected to the control arm 126. A pivotally mounted stabilizing arm 130 is connected to the shaft 124 to maintain the shaft 124 in a vertical orientation throughout its reciprocating motions.

In FIG. 1, a prior art chute or slide 132 is shown. The slide 132 is positioned to receive a package which drops from a conveyor platform 110 or the upper surface of the elevator 122. The slide 132 is directed downwardly away from the elevator 122 to convey dropped packages toward the operator's position such that the packages are deposited on the floor 134 of the machine beneath the outlet of the slide 132.

The slide 132 is effective to prevent a dropped package from falling into the mechanical apparatus positioned beneath the slide 132, including the stabilizing arm 130, the elevator control arm 126 and other operating apparatus shown and suggested schematically in FIG. 1. However, the package feed-in pusher 118 passes precariously close to the upper surface of the slide 132 as it is making its repeated passes around sprockets 136 and 138.

Packages which are typically wrapped in package elevating wrapping machines comprise meats, vegetables and other commodities supported on trays comprised of styrofoam, pressed fiberboard and similar materials. Such packages tend to adhere to the surface of the slide 132 and, hence, may not pass rapidly to the floor 134 of the wrapping machine.

In that event, and particularly for larger packages, a dropped package may be engaged by the package feed-in pusher 118 as it passes around the sprockets 136 and 138 to return to the feed-in tray 116. Such engagement can result in damage to the wrapping machine, destruction of the dropped package and/or jams of the wrapping machine. Further, a dropped package may fall onto a circulating platform 110 as it falls to the machine floor 134 or later be engaged by one of the platforms 110.

Figure 2:
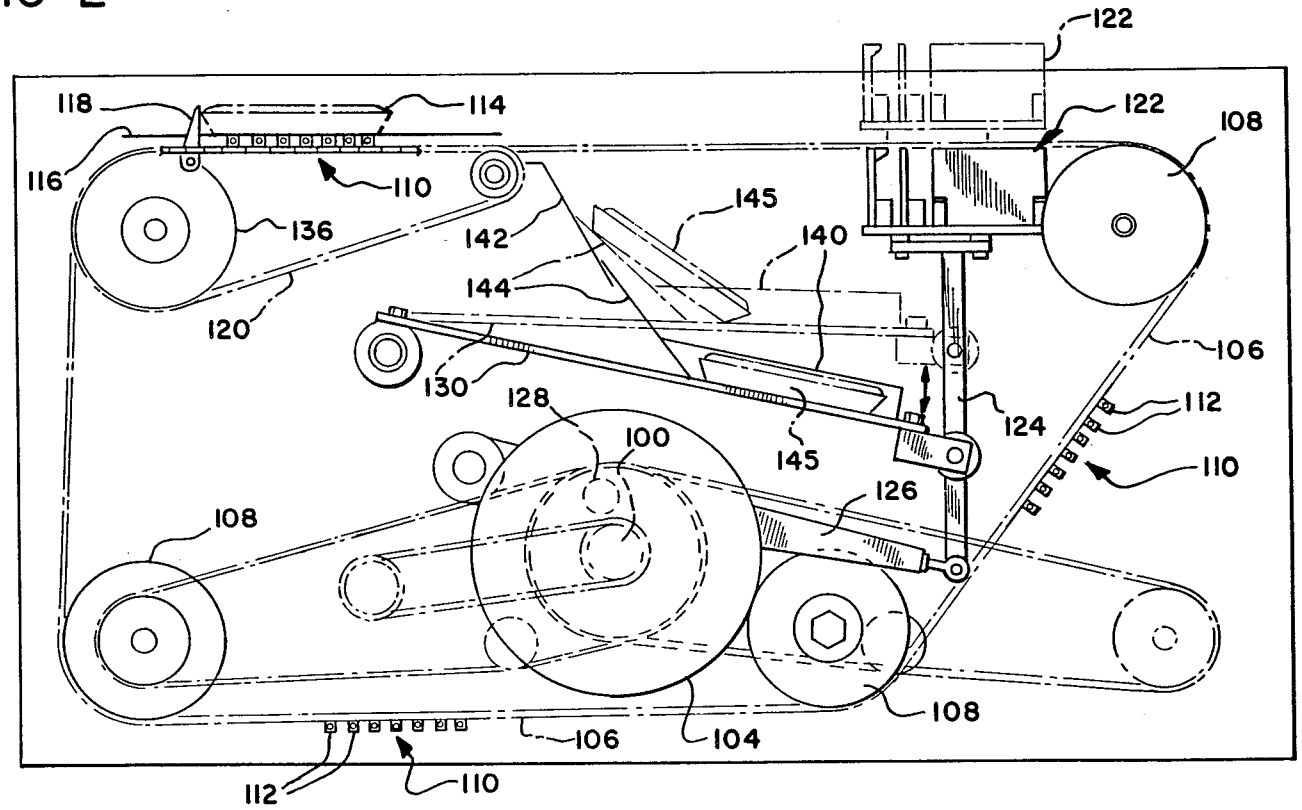
FIG. 2 is a diagrammatical vertical cross-section taken generally along the longitudinal center line of a package elevating wrapping machine illustrating the dropped package catcher in accordance with the present invention.
Figure 3:
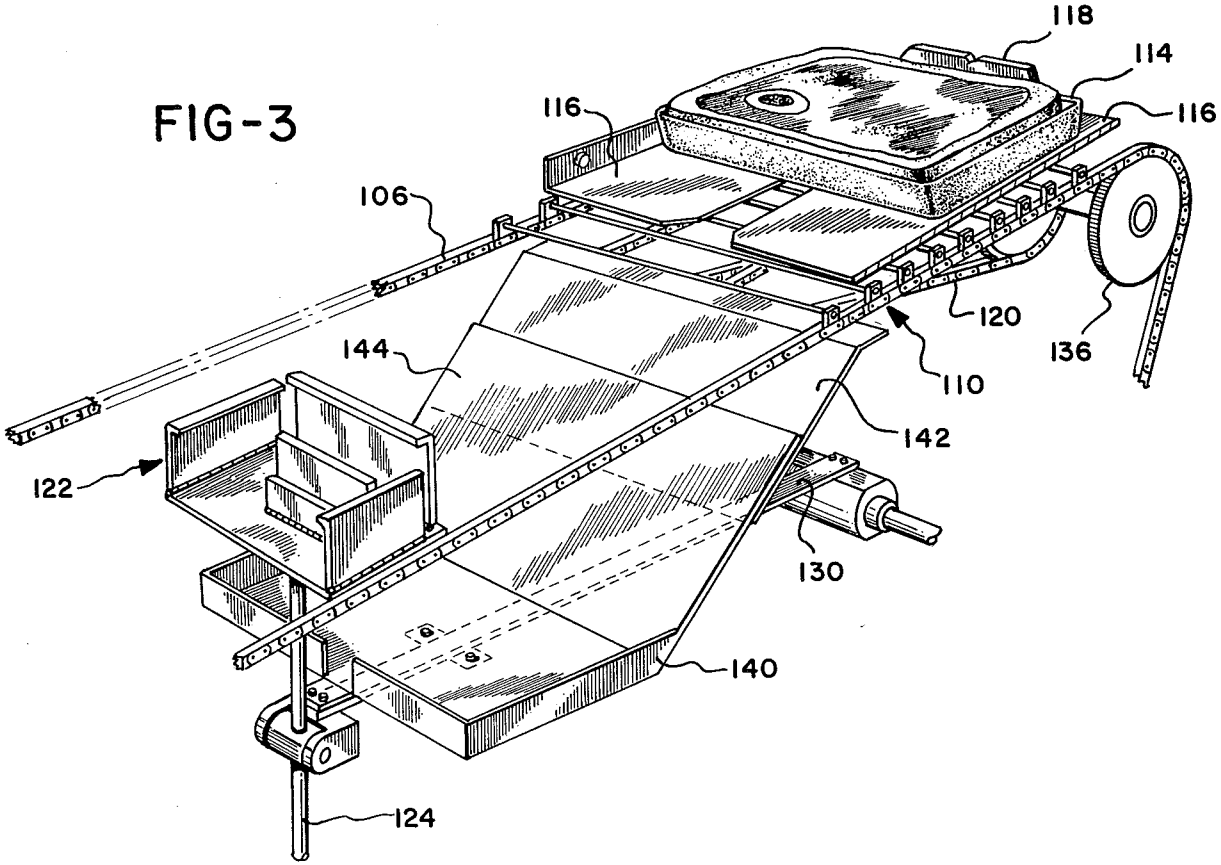
FIG. 3 is a perspective view illustrating the dropped package catcher in accordance with the present invention.

To overcome problems of dropped packages, package catcher means in accordance with the present invention are shown in FIGS. 2 and 3 and comprises a pan 140 which is coupled to the elevator stabilizing arm 130 to be reciprocated with the elevator 122. The pan 140, while conforming to the angular orientation of the stabilizing arm 130, is maintained in a generally horizontal attitude to receive packages which inadvertently fall from the elevator 122, one of the conveyor platforms 110 or the package feed-in tray 116.

To ensure that dropped packages are caught by the pan 140, a package guide 142 comprising a generally downwardly extending ramp is positioned just beyond the end of the package feed-in tray 116. One edge 144 of the pan 140 is angularly oriented and extended toward the package guide 142. The extended angularly oriented edge 144 of the pan 140 is oriented to be in substantial alignment with the guide 142 when the elevator 122 is in its lowered solid line position shown in FIG. 2. The distal end of the extended angularly oriented edge 144 of the pan 140 remains in close proximity to the guide 142 throughout the reciprocating motion of the elevator 122 as shown in FIG. 2. This arrangement ensures that a dropped package 145 will be directed into the pan 140 to prevent it from falling into the mechanical operating apparatus of the wrapping machine.

Once a package has been dropped from the package supporting apparatus of the wrapping machine and caught by the tray or pan 140, the operator stops the machine and opens a side panel of the machine to retrieve the package from the pan 140. Such package retrieval follows naturally since the machine is typically stopped after a package is dropped to allow the operator to remove the film sheet that was drawn into the machine but was not used to wrap the dropped package.

While the form of apparatus herein described constitutes a preferred embodiment of this invention, it is to be understood that the invention is not limited to this precise form of apparatus and that changes may be made therein without departing from the scope of the invention which is defined in the appended claims.

What is claimed is:

1. In a wrapping machine including an elevator for raising packages into sheets of wrapping material which are then wrapped about the packages and conveyor means for conveying packages from a feed-in tray to said elevator, an improvement comprising dropped-package catcher means coupled to said elevator to follow the reciprocating movement thereof for catching packages which may drop from said conveyor means or said elevator whereby dropped packages are prevented from engaging operating apparatus of the wrapping machine which engagement can otherwise lead to machine damage, destruction of the dropped packages and/or machine jams.

2. An improvement as claimed in claim 1 wherein said catcher means comprises a pan having upwardly extending edges.

3. An improvement as claimed in claim 2 wherein said catcher means further comprises a package guide positioned to direct packages from said package feed-in tray to said pan with the edge of said pan which extends toward said package guide being lengthened and angularly oriented to be substantially aligned with said guide when said elevator is in its lowered position with the distal end of said lengthened pan edge being in close proximity to said package guide throughout the reciprocating motion of said elevator.

4. An improvement as claimed in claim 3 wherein said elevator is supported on a shaft which is reciprocated in the vertical direction by a pivotally mounted elevator control arm and stabilized by a pivotally mounted stabilizing arm to maintain the shaft in a vertical orientation throughout its reciprocating motion and said catcher means is secured to said stabilizing arm.

* * * * *